US011930949B2

(12) United States Patent
Willows

(10) Patent No.: US 11,930,949 B2
(45) Date of Patent: Mar. 19, 2024

(54) GARMENT HANGER

(71) Applicant: Zickers, LLC, Seattle, WA (US)

(72) Inventor: Angus A. Willows, Seattle, WA (US)

(73) Assignee: Zickers, LLC, Seattle, WA (US)

( * ) Notice: Subject to any disclaimer, the term of this patent is extended or adjusted under 35 U.S.C. 154(b) by 65 days.

(21) Appl. No.: 17/804,615

(22) Filed: May 31, 2022

(65) Prior Publication Data

US 2023/0329468 A1 Oct. 19, 2023

Related U.S. Application Data

(60) Provisional application No. 63/331,875, filed on Apr. 18, 2022.

(51) Int. Cl.

| | |
|---|---|
| ***A47G 25/50*** | (2006.01) |
| ***A47G 25/34*** | (2006.01) |
| ***A47G 25/36*** | (2006.01) |
| ***A47G 25/48*** | (2006.01) |

(52) U.S. Cl.

CPC ..... *A47G 25/50* (2013.01); *A47G 25/34* (2013.01); *A47G 25/36* (2013.01); *A47G 25/487* (2013.01)

(58) Field of Classification Search

CPC ..... A47G 25/14; A47G 25/28; A47G 25/36; A47G 25/50; A47G 25/48; A47G 25/481; A47G 25/482; A47G 25/483; A47G 25/487

See application file for complete search history.

(56) References Cited

U.S. PATENT DOCUMENTS

| | | | | | |
|---|---|---|---|---|---|
| 1,904,277 | A * | 4/1933 | De Bucci | A47G 25/487 | 223/91 |
| 2,113,394 | A * | 4/1938 | Biri | A47G 25/28 | D6/319 |
| 2,210,344 | A * | 8/1940 | Sheinaus | A47G 25/54 | 223/91 |
| 2,222,231 | A * | 11/1940 | Marble | A47G 25/28 | D6/318 |
| 2,527,869 | A * | 10/1950 | Wintergreen | A47G 25/487 | 223/91 |
| 2,723,063 | A * | 11/1955 | Carr | A47G 25/481 | 223/91 |
| 3,421,669 | A * | 1/1969 | Ogg | A47G 25/487 | 223/91 |
| 5,664,709 | A * | 9/1997 | Graham | A47G 25/28 | 223/89 |
| 5,775,554 | A * | 7/1998 | Taylor | A47G 25/487 | 223/91 |
| 8,408,434 | B2 * | 4/2013 | Sevastianov | A47G 25/32 | 223/91 |
| 11,071,402 | B2 * | 7/2021 | Yau | A47G 25/10 | |

* cited by examiner

*Primary Examiner* — F Griffin Hall

(74) *Attorney, Agent, or Firm* — Lowe Graham Jones PLLC

(57) ABSTRACT

A garment hanger includes a hook having a terminal end and a neck. A first shoulder bar and a second shoulder bar extend away from the neck to support a clothing item. A support bar extends horizontally between the first shoulder bar and the second shoulder bar. A resilient clip stem is suspended beneath the neck and terminates in a clip bar positioned adjacent the support bar. The clip stem and clip bar are resiliently moveable between a resting position and an open position to receive a clothing item and retain the clothing item on the garment hanger.

19 Claims, 15 Drawing Sheets

GARMENT HANGER

PRIORITY CLAIM

This application claims the benefit of U.S. provisional application 63/331,875, filed Apr. 18, 2022, the contents of which are incorporated by reference.

FIELD OF THE INVENTION

This invention relates to garment hangers incorporating a spring to hold flat items.

BACKGROUND OF THE INVENTION

Garment or clothing hangers are commonly used for hanging, draping, or holding textiles or various articles of clothing. The standard hanger having a hook, opposing shoulder bars, and a bottom support bar is well known. While this works reasonably well for hanging a shirt or a jacket, it is more problematic for pants and certain other items which are prone to falling off the hanger. There is a need for improved or additional features that aid in securing certain clothing articles or textiles to the hanger.

SUMMARY OF THE INVENTION

In accordance with preferred aspects of the invention, an improved garment hanger is arranged to allow for hanging and clamping of textiles or clothing to prevent them from falling from the hanger. Most preferably, this is achieved in a simple manner, further allowing the user to remove the items from the hanger without performing discrete steps to detach the items before removal.

The preferred garment hanger includes a resilient, or spring-loaded, clip positioned adjacent the bottom support bar. In some versions, the clip is formed as a horizontal bar parallel to the bottom support bar. The clip may contact the bottom support bar when in a resting position, or may be slightly separated from the bottom support bar in the resting position. Most preferably, the clip may be urged away from the bottom support bar upon application of a force by a user, to facilitate insertion or removal of a clothing item or other object. The resilient or spring-loaded nature of a spring body mounted to the clip causes the clip to return to the resting position upon removal of the force.

The clip is preferably integrally formed with the body of the hanger, without any fasteners, hinges, or other forms of connection. In other versions, it may be attached using fasteners, hinges, or other forms of connection. This allows for the product to be manufactured with low cost and a simple design. The hanger spring design can alternatively serve as a two-part clamp with spring and hinge to clamp on to textiles, clothing, or garments rather than acting like a static nondeforming body.

In accordance with preferred versions of the invention, the garment hanger may include a hook having a terminal end and a neck and defining an opening between the terminal end and the neck. A first shoulder bar extends laterally away from the neck in a first direction and terminating in a first shoulder bar distal end and a second shoulder bar extends laterally away from the neck in a second direction and terminating in a second shoulder bar distal end. A support bar extends between the first shoulder bar distal end and the second shoulder bar distal end.

A clip stem has an upper end supported by the garment hanger beneath the neck, with a clip stem distal end extending away from the upper end and toward the support bar. The clip stem further has a clip bar at the clip stem distal end wherein a gap is defined between the clip bar and the support bar. The clip bar is resiliently moveable between a resting position in which the clip bar is positioned adjacent the support bar and an open position in which the clip bar is moved away from the support bar upon application of an external force, the gap being relatively larger in the open position than in the resting position.

In some versions, the gap between the clip bar (or the clip stem) and the support bar is less than 1 cm in the resting position, and more preferably less than 0.5 cm, and even more preferably the gap is essentially zero in that the clip bar or clip stem are in contact with the support bar in the resting position.

In some versions, the clip bar includes a first bar portion extending to the first shoulder bar distal end, and a second bar portion extending to the second shoulder bar distal end.

In some examples, the upper end of the clip stem is attached to the neck.

In some examples, the upper end of the clip stem is further attached to at least one of the first shoulder bar or the second shoulder bar.

In other examples, the upper end of the clip stem is attached to both the first shoulder bar and the second shoulder bar.

In some versions, the upper end of the clip stem defines a first width and the distal end of the clip stem defines a second width, the first width being equal to the second width.

In other versions, the upper end of the clip stem defines a first width and the distal end of the clip stem defines a second width, the first width being greater than the second width.

Versions of the garment hanger may include one or more strap wells, including a first strap well and a second strap well. In some versions, the first strap well is formed in the first shoulder bar and the second strap well is formed in the second shoulder bar. In other versions, the first strap well and the second strap well are each formed in the support bar. In yet other versions, the first strap well and the second strap well are each formed in the clip bar.

In some versions, the garment hanger is integrally formed from a single material. The single material may be plastic or other materials such as metal, and may be a single metal wire.

In some versions, the garment hanger includes a hook having a terminal end and a neck and defining an opening between the terminal end and the neck. A first shoulder bar extends downwardly away from the neck in a first direction and terminates in a first shoulder bar distal end, while a second shoulder bar extends downwardly away from the neck in a second direction and terminates in a second shoulder bar distal end. A support bar extends between the first shoulder bar distal end and the second shoulder bar distal end.

A clip stem has an upper end suspended beneath the neck, the clip stem being resiliently moveable between a resting position and an open position. The clip stem has a clip stem distal end opposite the upper end, the clip stem distal end being positioned adjacent the support bar when the clip stem is in the resting position, wherein a gap is defined between the clip stem distal end and the support bar. The clip stem in the open position is moved away from the support bar upon application of an external force, the gap being relatively larger in the open position than in the resting position.

In some examples, a clip bar having a first bar portion extends toward the first shoulder bar distal end, and a second bar portion extends toward the second shoulder bar distal end.

In some examples, a portion of the first bar portion is adjacent to the first shoulder bar to define a first shoulder bar gap between the first bar portion and the first shoulder bar, and a portion of the second bar portion is adjacent to the second shoulder bar to define a second shoulder bar gap between the second bar portion and the second shoulder bar, each of the first shoulder bar gap and the second shoulder bar gap being less than 1 cm.

In some versions, the upper end of the clip stem defines a first width and the distal end of the clip stem defines a second width, the first width being greater than the second width.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
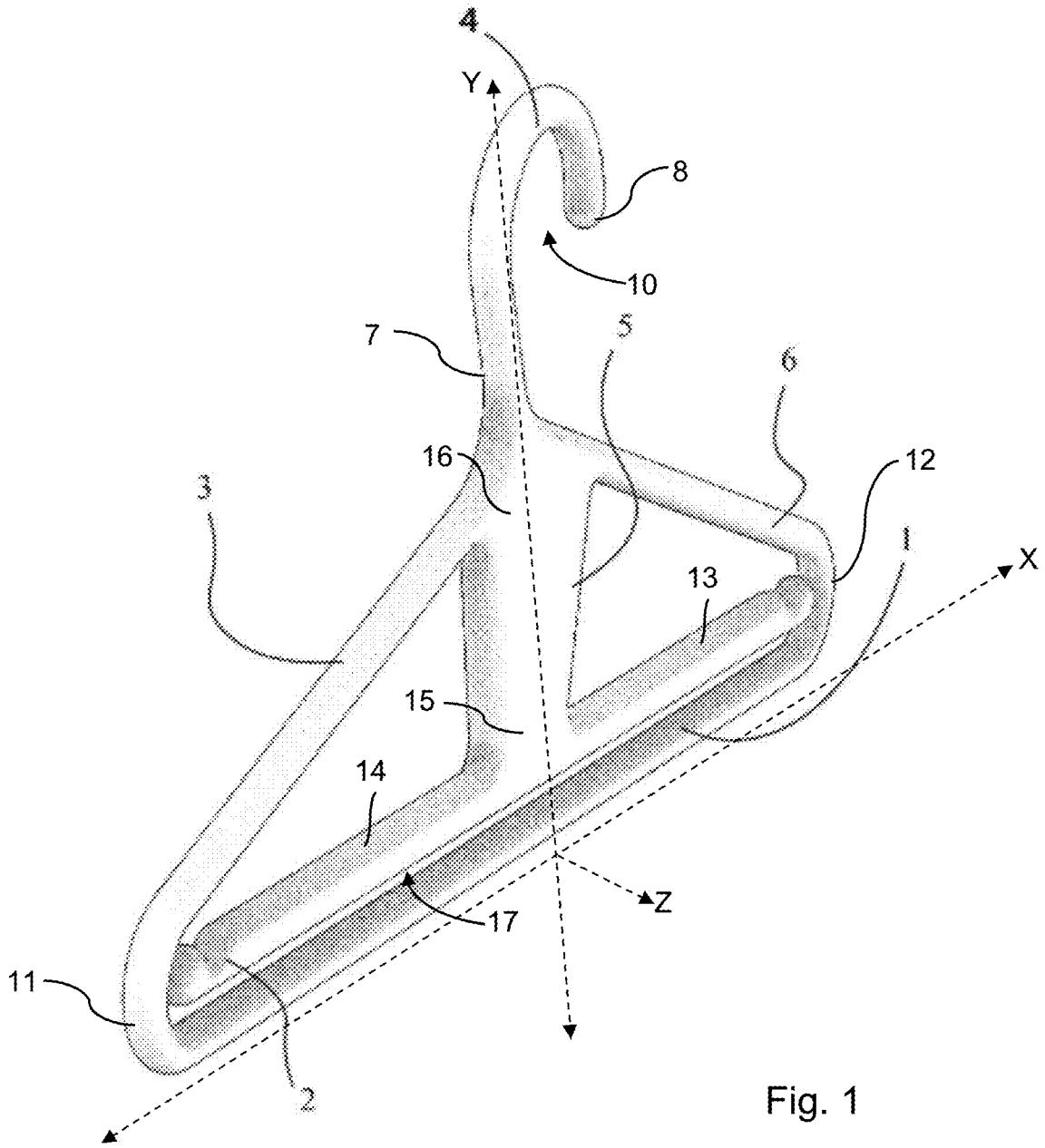
FIG. 1 shows a perspective view of a preferred embodiment of a garment hanger.

FIG. 1 shows a front perspective view of a preferred embodiment of a garment hanger. As illustrated, the garment hanger includes an upper hook 4 arranged to receive a clothing rod so that the garment hanger may be suspended from the clothing rod. The hook preferably includes a terminal or distal end 8 and a neck 7 defining an opening 10 for receiving the clothing rod. The neck transitions to a pair of shoulder bars, which preferably are in the form of a first shoulder bar 3 and a second shoulder bar 6, each extending laterally away from the neck in directions generally opposite one another, and downwardly away from the hook. A bottom support bar 1 is joined to and extends between the terminal ends 11, 12 of the shoulder bars, and thus defines a support bar extending in a generally horizontal direction (as indicated by the X-axis in FIG. 1) when the garment hanger hook is suspended from a clothing rod or similar hanging support structure.

In the version of FIG. 1, a clip is attached to the hanger in the form of a clip stem 5 terminating in a clip bar 2. In this example, the clip stem includes an upper end 16 which is attached to and extends vertically downward (along the Y-axis in FIG. 1) from the neck of the hanger, in a direction opposite the hook 4 which extends vertically upward from the neck 7, so that the clip stem terminates at its distal end 15. Most preferably, the clip stem is integrally formed from the same material forming the rest of the hanger. The clip bar 2 in the illustrated example is configured as a horizontal bar which is parallel to the bottom support bar 1. In the illustrated version, the clip bar includes a first bar portion 13 and a second bar portion 14, each extending away from the distal end of the clip stem in directions opposite one another. As shown, when the clip bar is in a resting position (that is, without any external force applied to the clip, and without any garment mounted on the hanger), the clip bar is closely adjacent the horizontal support bar. In some examples, such as in the illustration of FIG. 1, a clip bar gap 17 is provided between the clip bar and the horizontal support bar when the clip bar is in the resting position. Most preferably, the gap is less than 1.0 cm, or more preferably the gap is 0.5 cm or less. In some versions, the clip bar is in contact with the support bar in the resting position.

In some versions, the clip stem may serve as a backboard to press textiles, clothing, or garments against. In addition, the clip stem acts as a spring to allow the clip bar to be moved away from and toward the support bar. Upon application of an external force against the clip stem or the clip bar in a direction transverse to or perpendicular to the plane of the hanger (that is, in the direction of the Z-axis in FIG. 1), the clip stem flexes relative to the horizontal support bar 1 to move to an open position and to thereby increase the size of the gap 12. In this open position, a clothing item such as a pair of pants can be inserted into the gap to be supported by the horizontal support bar. Upon removal of the force, the resilience of the clip stem causes it to return to its resting position and acts as a restraint for the garment or textiles which are then trapped between the bottom support bar and the clip bar.

Figure 2:
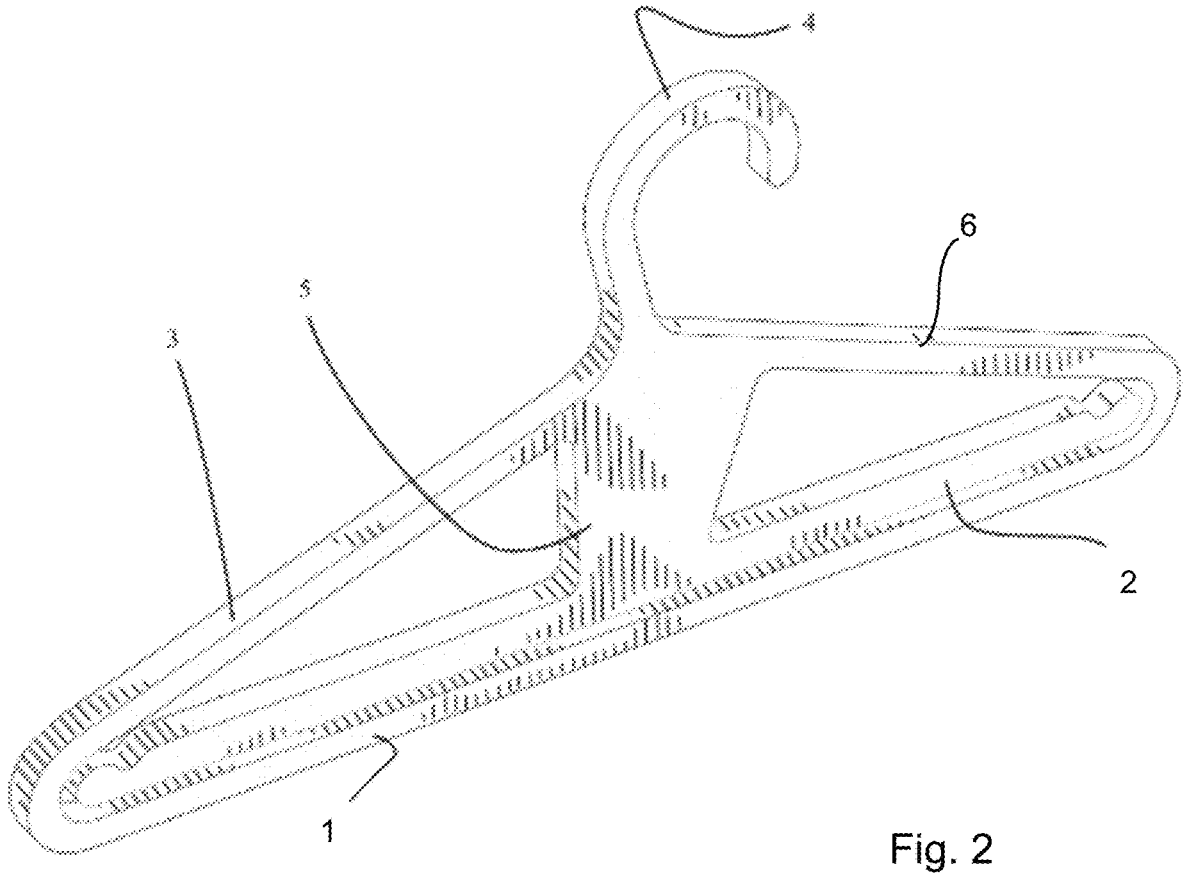
FIG. 2 shows a perspective view of an alternate embodiment of the garment hanger.

FIG. 2 shows a perspective view of a preferred garment hanger, in this case without filleted edges. In all other respects, the version of FIG. 2 is the same as that of FIG. 1.

Figure 3:
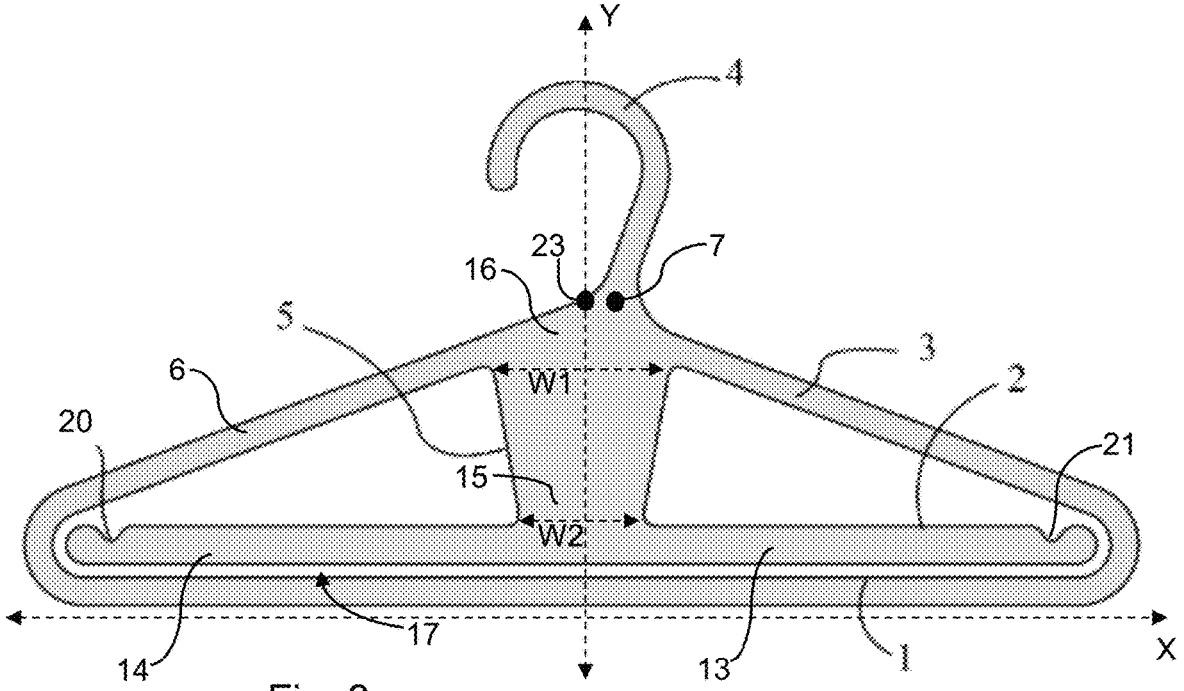
FIG. 3 shows a front elevational view of the preferred garment hanger as shown in FIG. 2.

FIG. 3 shows a front elevational view of a preferred embodiment of a garment hanger configured in accordance with the garment hanger as illustrated and described with respect to FIGS. 1 and 2. In this example, the garment hanger is generally planar, so that the shoulder bars, hook, support bar, and clip bar lie in a plane defined by the X-Y axes. In this version, the clip bar includes a pair of strap wells 20, 21, one formed in the upper side of the distal end of each of the first bar portion 13 and the second bar portion 14 of the clip bar 2. Each strap well is configured as a small concavity or channel extending perpendicularly to the X-Y plane, and thus perpendicularly to the plane defined by the hanger.

In this example, the neck 7 of the hook terminates at a location where the first and second shoulder bars and the clip stem meet, as indicated by an added circle at the end of the lead line from reference number 7 in FIG. 3. This location for the base of the neck is offset from the center of the garment hanger, which extends through the vertical axis Y in FIG. 3, and is indicted by center point 23. In other versions, the base of the neck 7 may coincide with the horizontal center of the hanger.

The clip stem 5 in this example is generally trapezoidal in shape, having an upper end 16 with an upper clip stem width W1 which is wider than a lower clip stem width W2 measured at the lower end 15 of the clip stem 5. The width W1 is measured where the clip stem contacts the first and second shoulder bars, while the width W2 is measured where the clip stem contacts the first and second bar portions 12, 13 of the clip bar. The clip bar gap 17 between the clip bar and the horizontal support bar is visible in FIG. 3, and in this example the gap is greater than zero.

Figure 4:
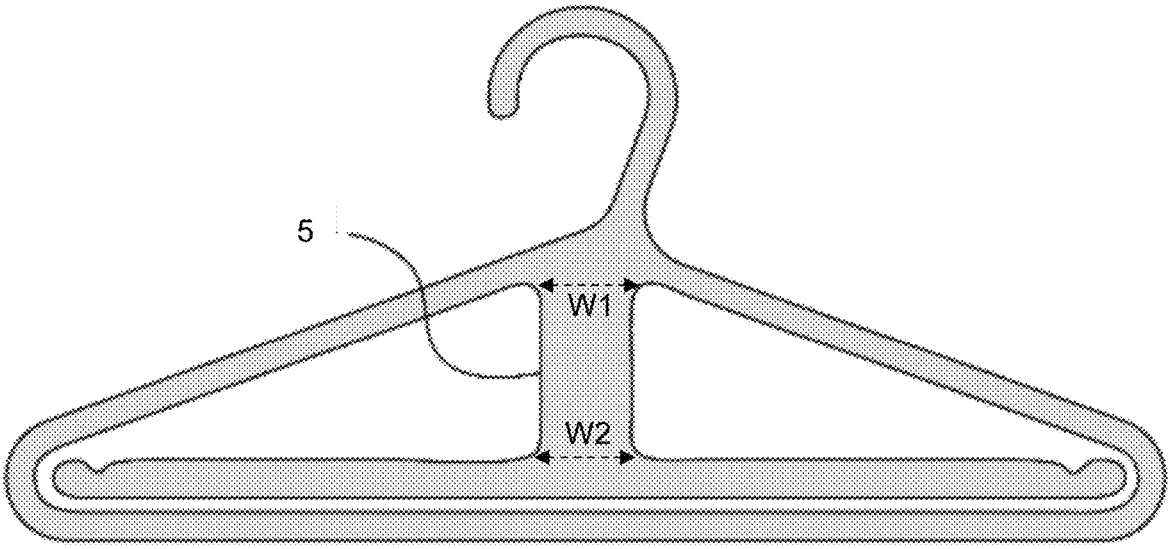
FIG. 4 shows a front elevational view of an alternate embodiment of a garment hanger.

FIG. 4 shows a front elevational view of an alternate garment hanger. The garment hanger of FIG. 4 is the same as that of FIG. 3 in all respects other than the configuration of the clip stem 5. In this example, the clip stem is substantially rectangular in shape when viewed from the front elevational perspective, rather than being trapezoidal. Accordingly, the width W1 of the upper end of the clip stem is the same as the width W2 of the lower end of the clip stem. The difference in configuration of the clip stem may affect the strength and resilience of the clip stem, in that the trapezoidal version may be sturdier and require a stronger external force in order to move the clip stem and clip bar out of the horizontal plane of the hanger (from its resting position to an open position) to increase the size of the gap and allow the insertion of a garment.

Figure 5:
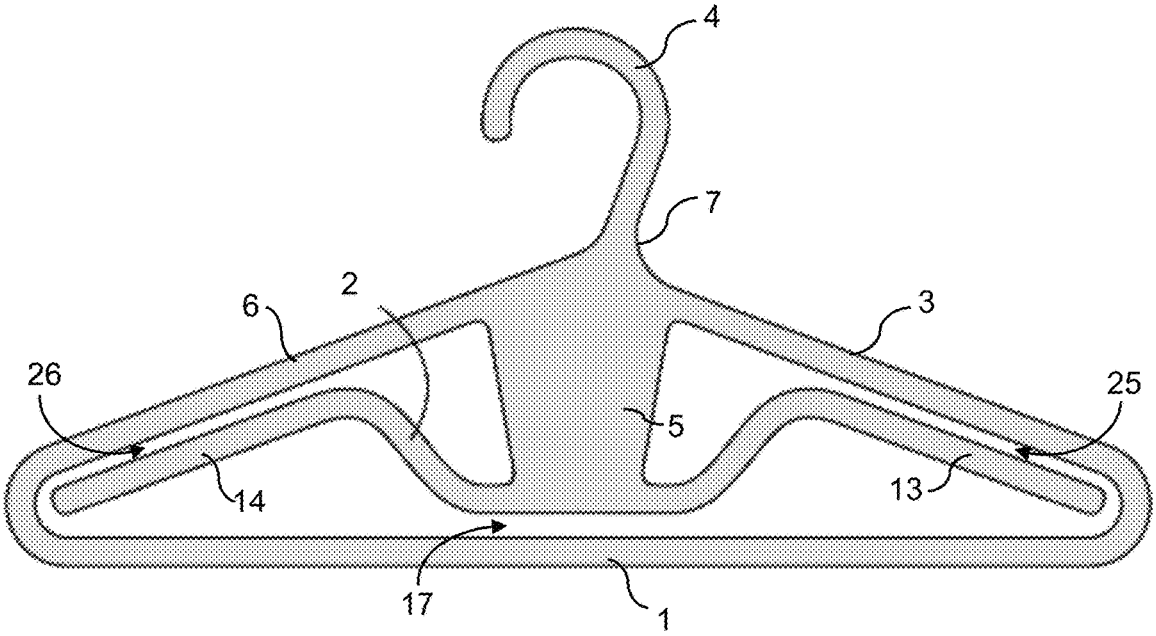
FIG. 5 shows a front elevational view of an alternate embodiment of a garment hanger.

FIG. 5 shows a front elevational view of an alternate embodiment of a garment hanger, in this case having a trapezoidal clip stem. In addition, in this embodiment the clip bar is arranged so that the first and second clip bar portions 13, 14 are more closely adjacent to the first and second shoulder bars 3, 6 and spaced farther away from the horizontal support bar 1. A first shoulder bar gap 25 is provided between the first shoulder bar 3 and the first clip portion 13, with the size of this gap being the same as that described above with respect to the clip bar gap 17 for the embodiment of FIGS. 1 and 3. A second shoulder bar gap 26 is likewise provided between the second shoulder bar 6 and the second clip portion 14, with the size of this gap also being the same as that described above with respect to the clip bar gap 17 for the embodiment of FIGS. 1 and 3. Thus, a garment may be trapped between the first and second shoulder bar gaps to aid in retaining it on the garment hanger.

The embodiment of FIG. 5 further includes a clip bar gap 17, and in a preferred implementation the clip bar gap is sized as described above with respect to FIG. 1 with respect to a portion of the clip bar beneath and immediately adjacent the clip stem 5. As each clip bar extends away from the clip stem, however, the clip bar gap 17 is widened in order to facilitate a smaller first shoulder bar gap 25 and second shoulder bar gap 26. Accordingly, in this version the clip bar gap 17 is small as described above with respect to FIG. 1 at the center of the hanger and therefore may serve to trap a garment such as a pair of pants between the clip bar (or lower end of the clip stem) and the horizontal support bar. Likewise, in this version, the first and second shoulder bar gaps can trap a garment between the first and second shoulder bars and the first and second clip bar portions.

Figure 6:
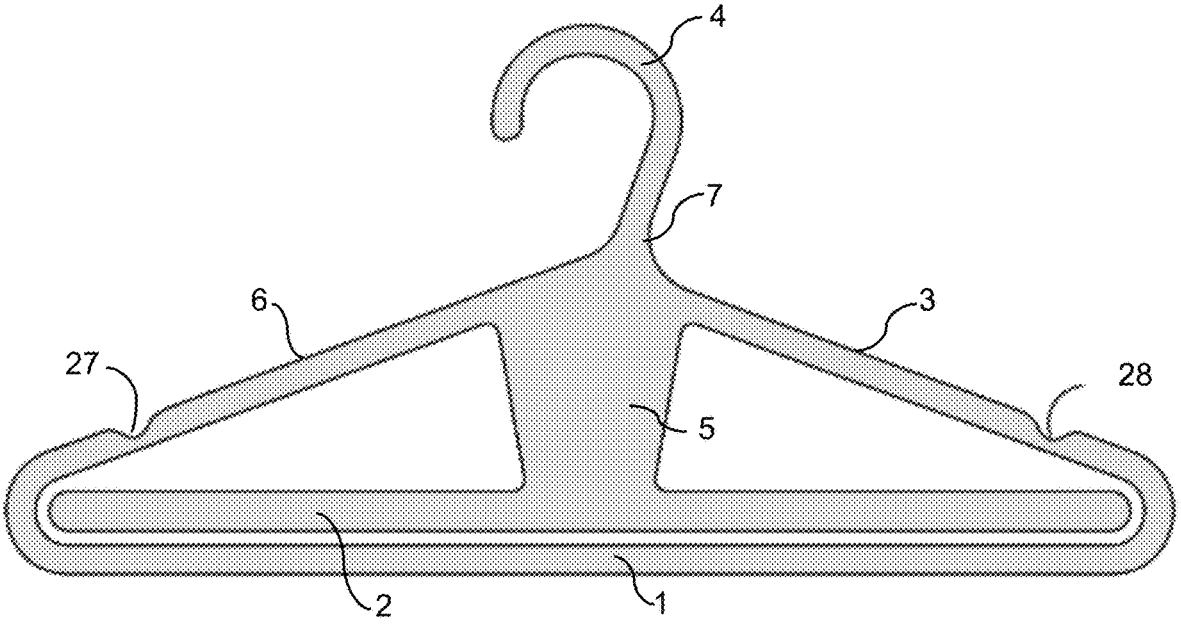
FIG. 6 shows a front elevational view of an alternate embodiment of a garment hanger.

FIG. 6 shows a front elevational view of an alternate embodiment of a garment hanger which is the same as the garment hanger embodiment of FIG. 3 except for the inclusion of a pair of strap wells, including a first strap well 27 and a second strap well 28, each positioned on an upper surface of the first and second shoulder bars.

Figure 7:
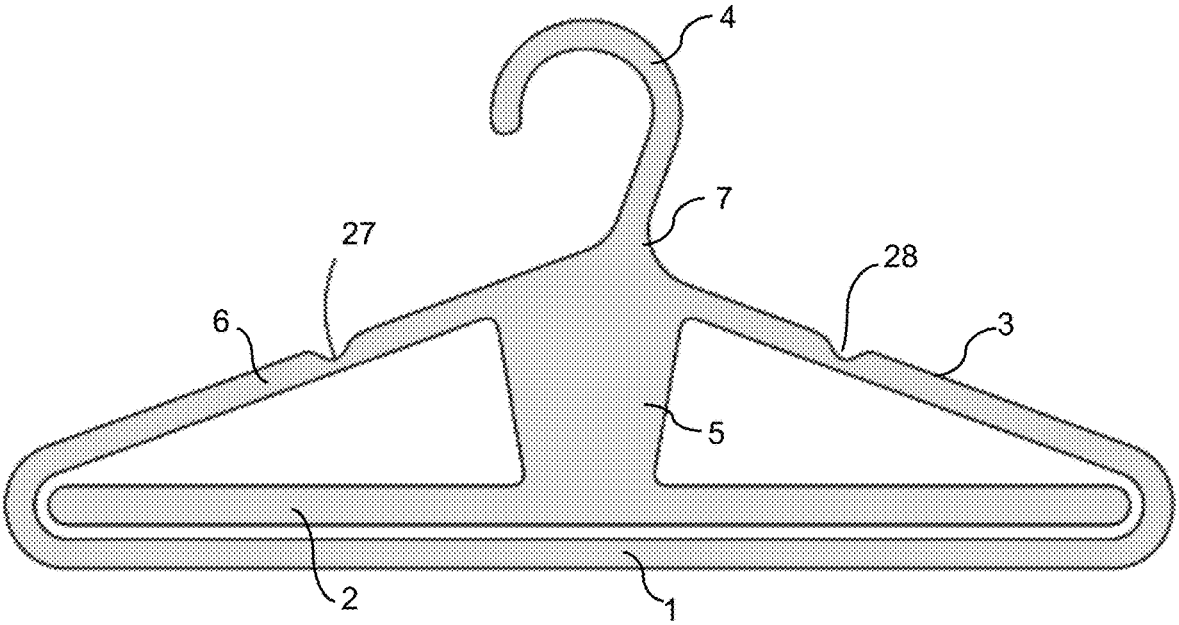
FIG. 7 shows a front elevational view of an alternate embodiment of a garment hanger.

FIG. 7 shows a front elevational view of an alternate embodiment of the garment hanger which is the same as that of the embodiment of FIG. 6 except that the first and second strap wells 27, 28 have been moved from the locations at the distal ends of the first and second shoulder bars to inward locations which are closer to the neck 7 of the hanger.

Figure 8:
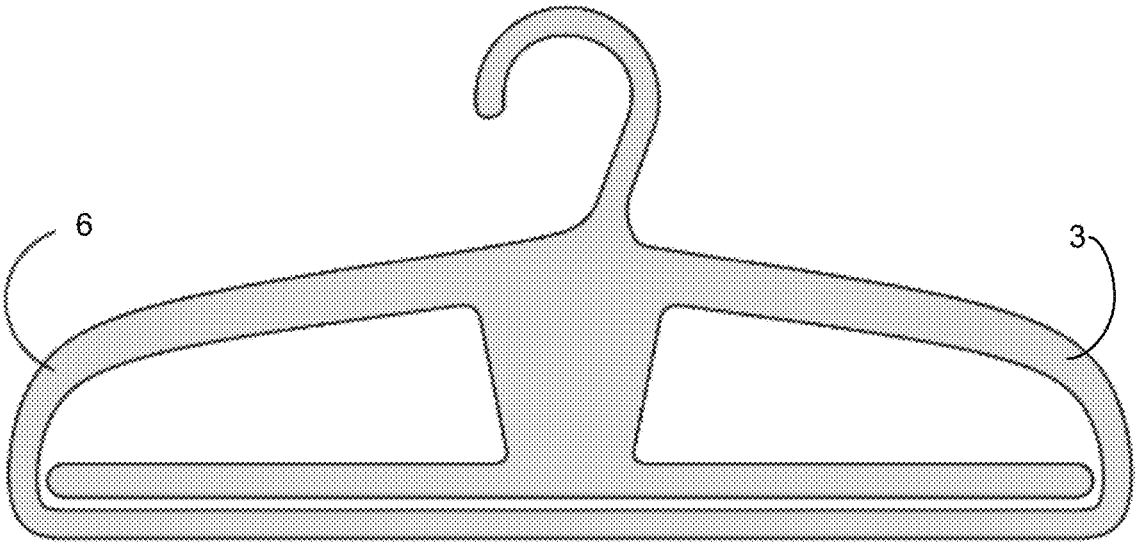
FIG. 8 shows a front elevational view of an alternate embodiment of a garment hanger.

FIG. 8 shows a front elevational view of a further embodiment of the coat hanger, which differs principally in that the first and second shoulder bars 3, 6 are relatively more horizontal than the versions of the prior embodiments.

Figure 9:
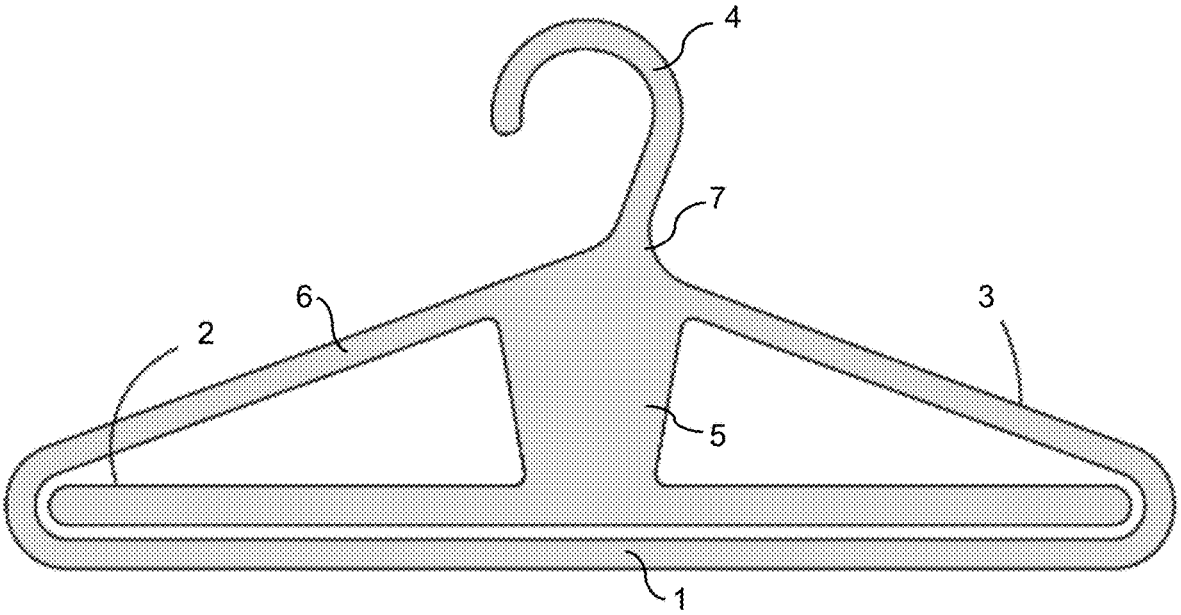
FIG. 9 shows a front elevational view of an alternate embodiment of a garment hanger

FIG. 9 shows a front elevational view of another preferred embodiment of the garment hanger, which in this case is the same as that of FIG. 7 except that it does not include any strap wells on either the shoulder bars or the clip bar.

Figure 10:
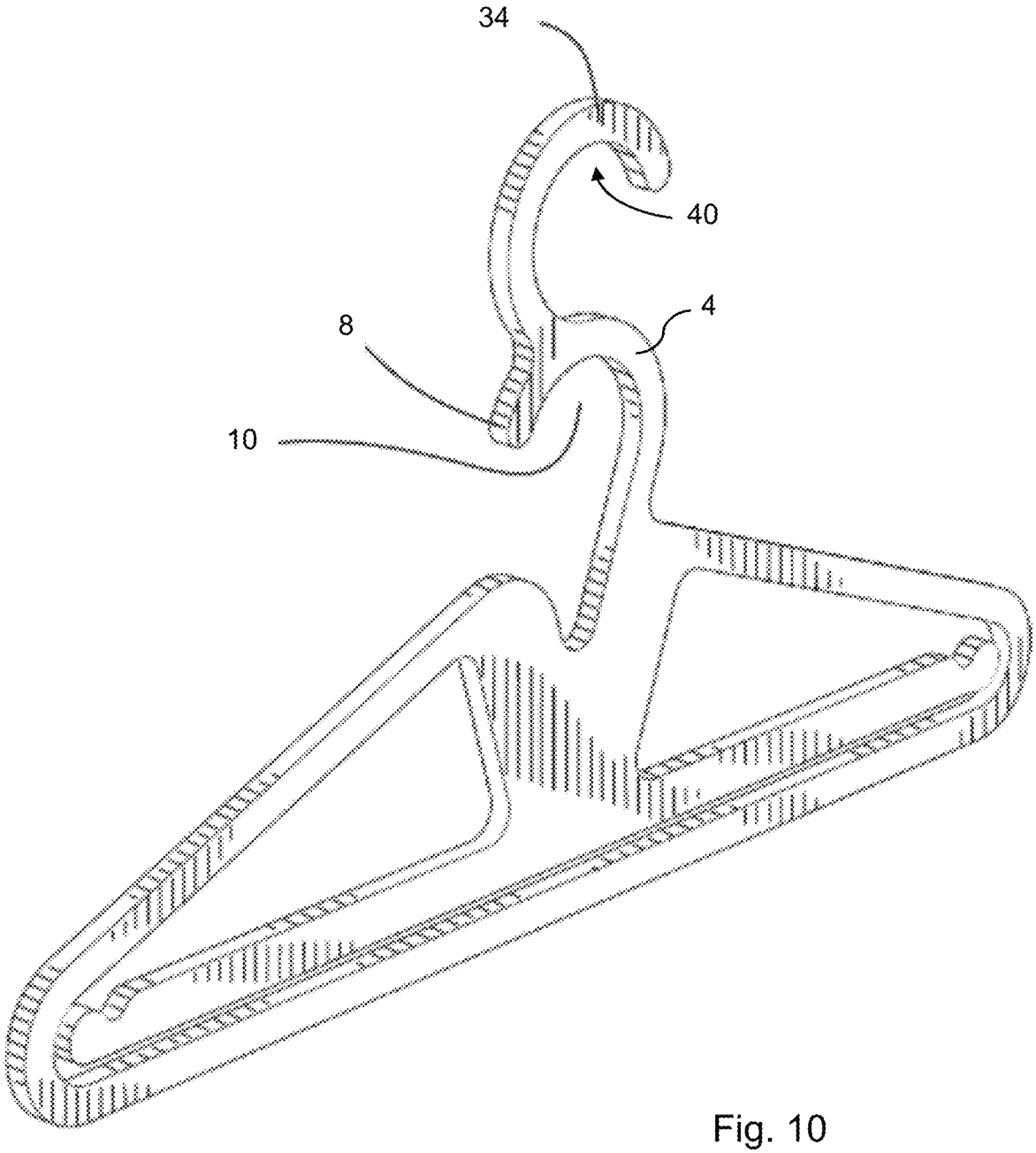
FIG. 10 shows a perspective view of an alternate embodiment of a garment hanger.

FIG. 10 shows a perspective view of a further embodiment of a garment hanger, incorporating a double hook. A first hook 4 is provided, as with the hook 4 described above in the prior embodiments of the invention. The first hook includes a distal end 8 and defines a first opening 10 to receive a rod or other supporting fixture. A second hook 34 is also provided, attached to the first hook and extending above it. The second hook defines a second opening 40 to receive the rod as described above. As shown, the hooks are oriented in opposite directions so that the garment hanger may be inserted into a closet to receive the clothing bar in either of two opposite directions.

Figure 11:
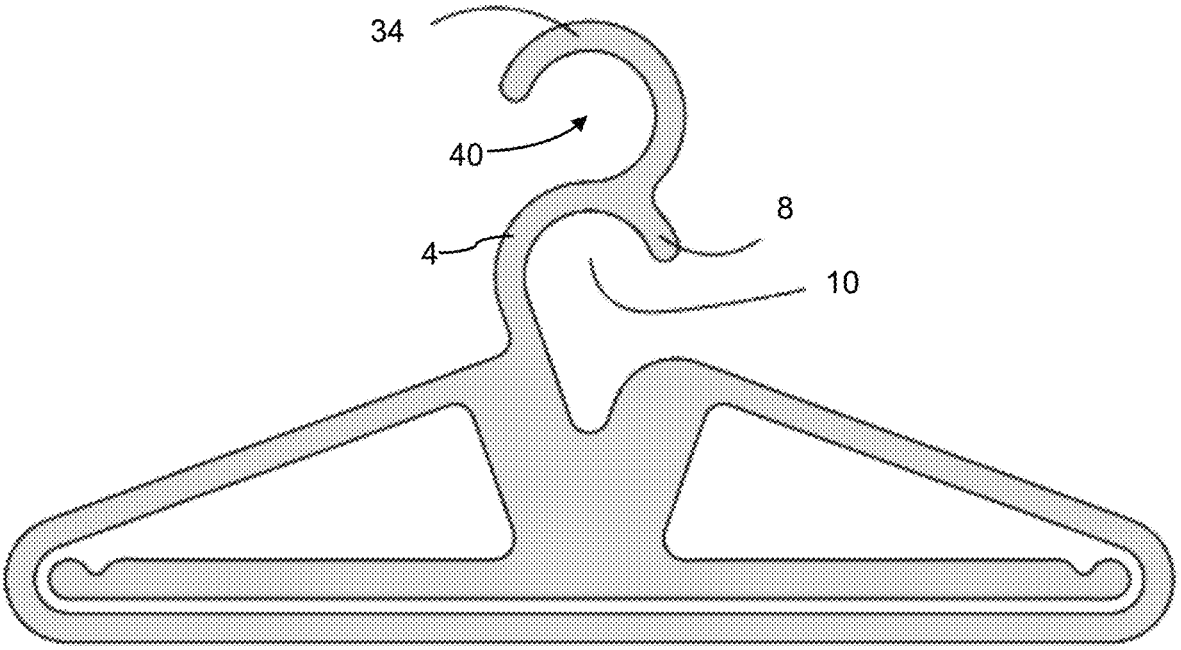
FIG. 11 shows a front elevational view of an alternate embodiment of a garment hanger.

FIG. 11 shows a rear elevational view of the garment hanger as shown and described with respect to FIG. 10, in this case rotated 180 degrees to view it from the rear rather than from the front.

Figure 12:
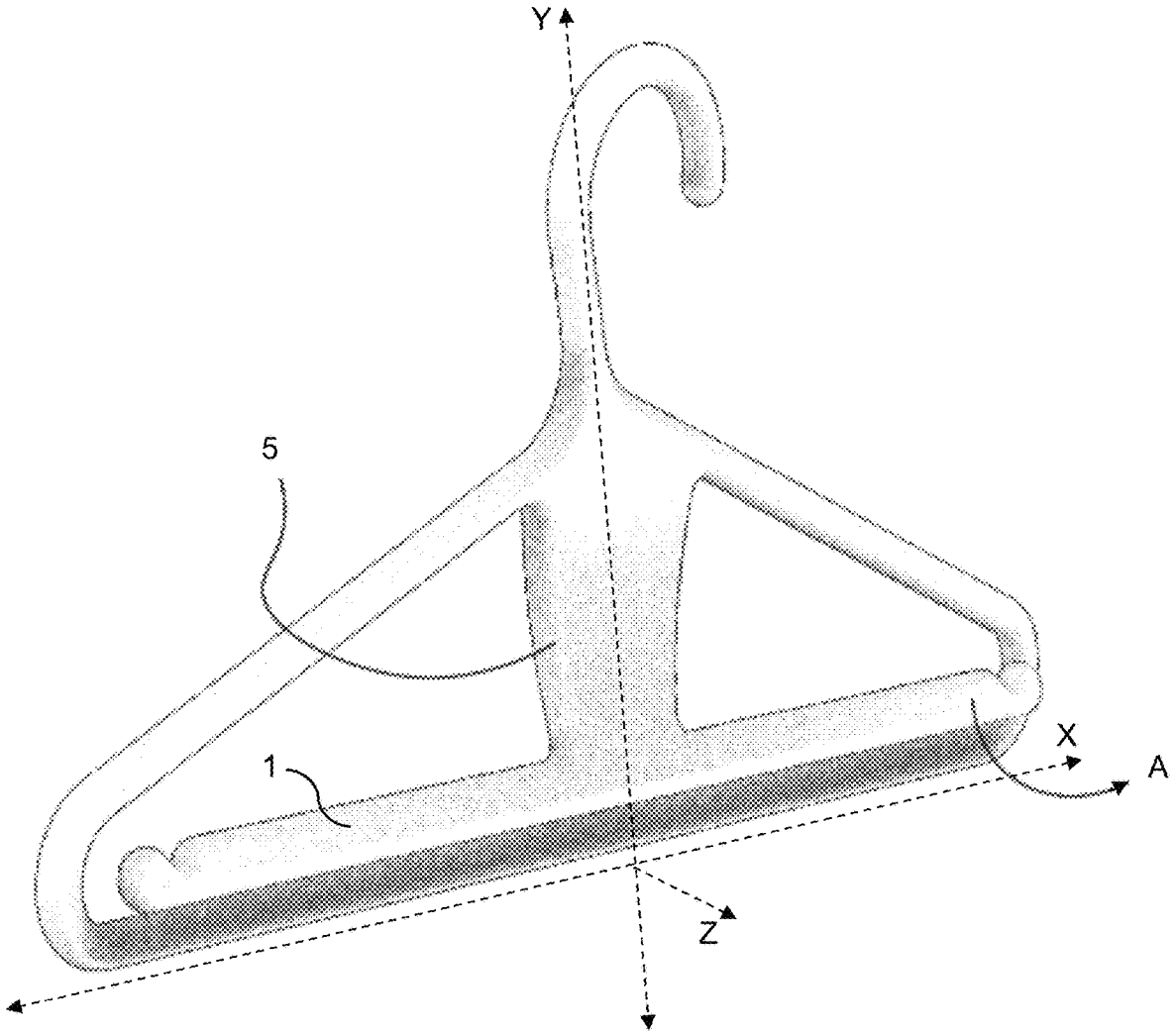
FIG. 12 shows a perspective view of an alternate embodiment of a garment hanger.

FIG. 12 shows a perspective view of a preferred garment hanger showing the clip stem moved to an open position so that the clip stem 5 and the clip bar 1 are moved out of the X-Y plane and outward along the Z-axis, in the direction as indicated by arrow A. While FIG. 12 shows the clip stem and clip bar extending in a direction out of the page, in a positive direction along the Z-axis, the clip stem 5 and clip bar 1 may alternatively move in the opposite direction into the page or in a negative direction along the Z-axis.

Figure 13:
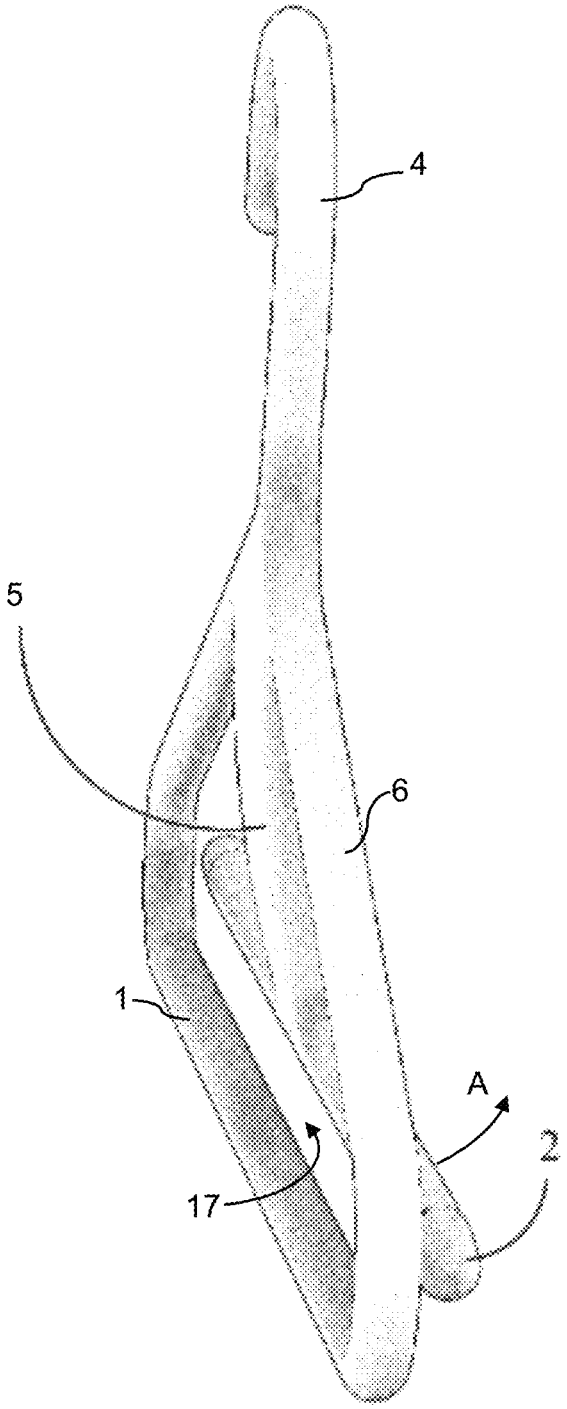
FIG. 13 shows a side perspective view of the embodiment of a garment hanger as shown in FIG. 12.

FIG. 13 shows a rear-left-side perspective view of the garment hanger of FIG. 12, shown in the same open position as illustrated in FIG. 12. In this view, and in this position, the gap 17 has been widened because of the movement of the clip bar outwardly in the direction of the arrow A in FIG. 13, to thereby create greater separation between the clip bar 2 and the support bar 1, allowing a garment to be more readily inserted between the clip bar 2 and the support bar 1.

Figure 14:
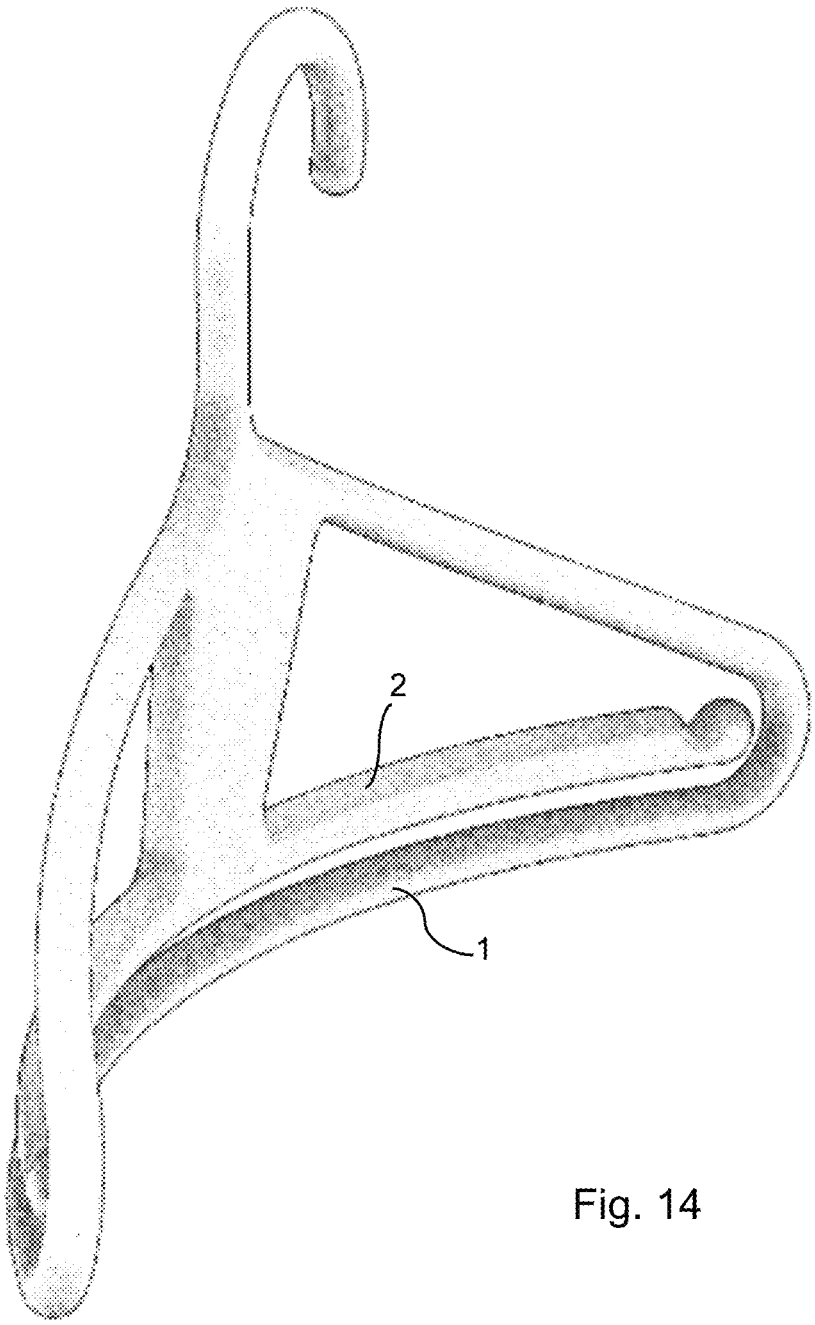
FIG. 14 shows a perspective view of an alternate embodiment of a garment hanger.

FIG. 14 shows a perspective view of an alternate garment hanger, which may include features as described above but in which the hanger is curved rather than being planar. Thus, each of the support bar and the clip bar are curved rather than being straight and lying in a common plane such as with the versions described above.

Figure 15:
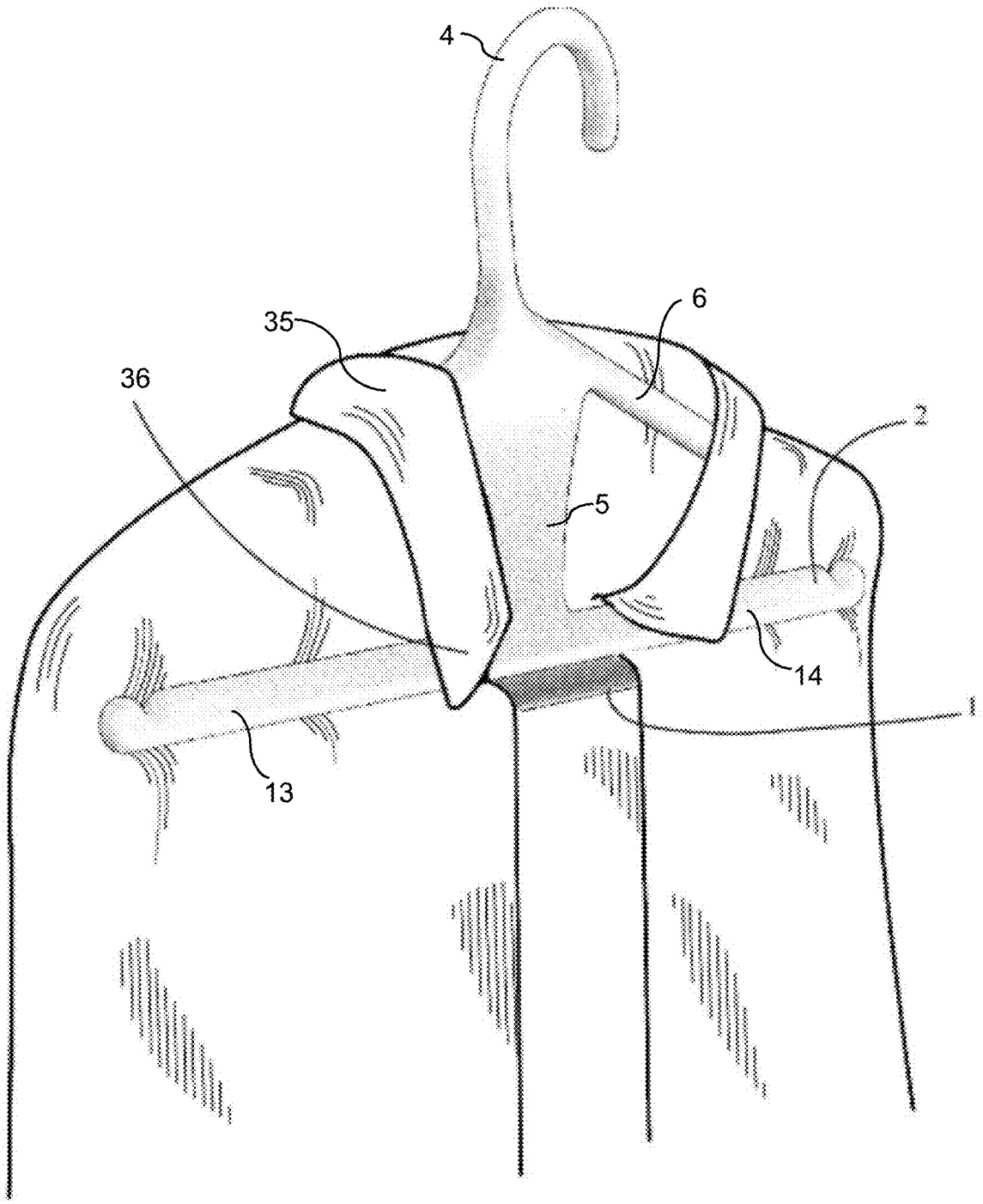
FIG. 15 shows a perspective view of a preferred garment hanger with a textile or clothing item supported by the garment hanger.

FIG. 15 shows a perspective view of a preferred garment hanger, illustrated with an exemplary clothing item (in this case, a shirt 35) being clamped by the clip bar. In particular, a portion of the clothing item is retained between the clip bar 2 and the support bar 1. The clip bar will have been moved to an open position to allow the shirt to be more readily inserted into the gap, then returned to its resting position to retain the clothing item as shown. A portion of the folded fabric or collar 36 of the clothing item (in this case, the shirt 35) rests over the clip bar and is not pressed by the clip bar.

Figure 16:
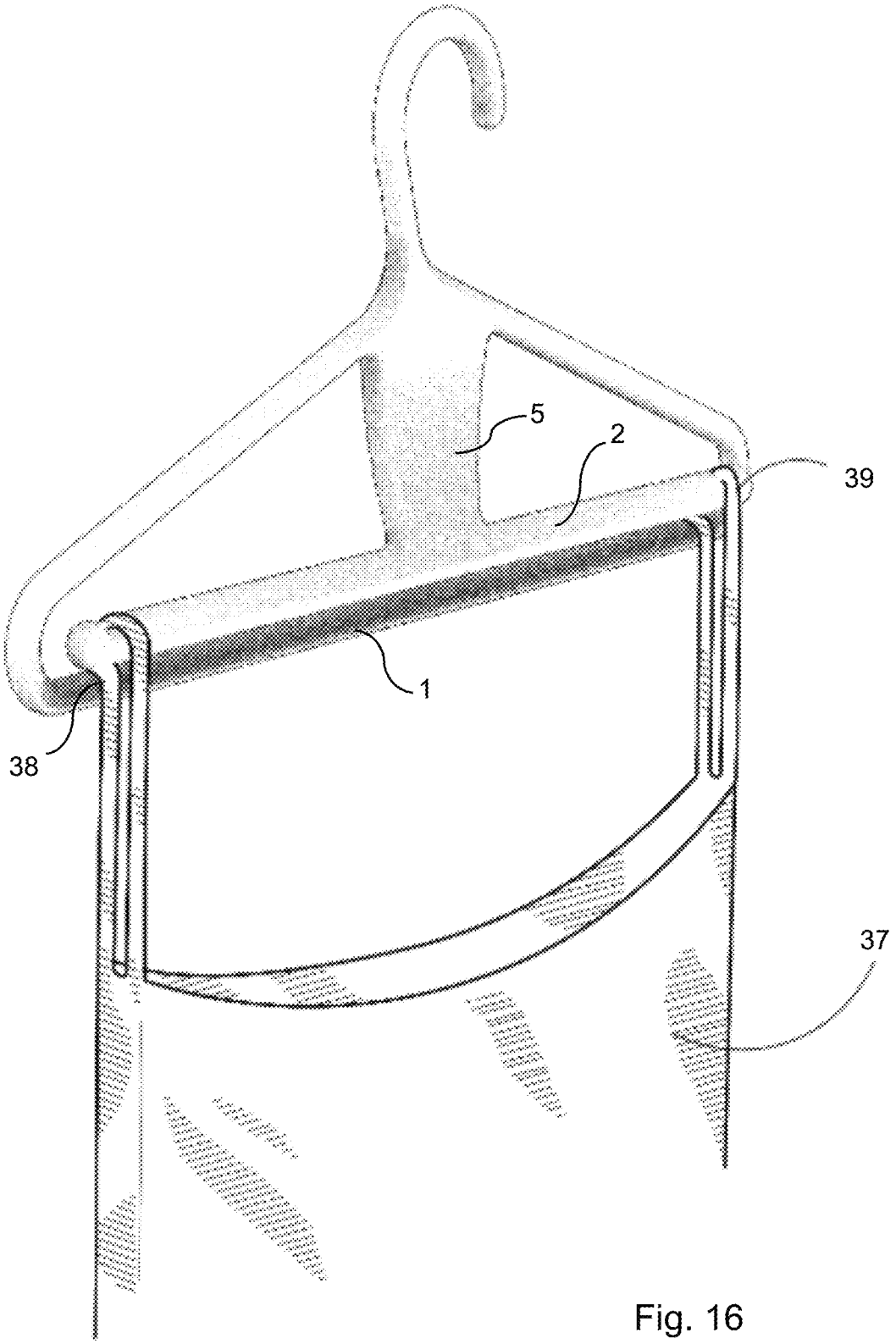
FIG. 16 shows a perspective view of a preferred garment hanger with a textile or clothing item in place and supported by a pair of strap wells.

FIG. 16 shows a perspective view of a preferred garment hanger, in this case supporting a clothing item 37 having a pair of straps 38, 39. The straps are received within one of a pair of strap wells 20, 21 formed in the clip bar, such as illustrated and described above with respect to FIG. 3. A portion of the straps are also retained in the gap between the clip bar 2 and the support bar 1, so that in the resting position the clip bar presses the strap against the support bar to retain it.

Figure 17:
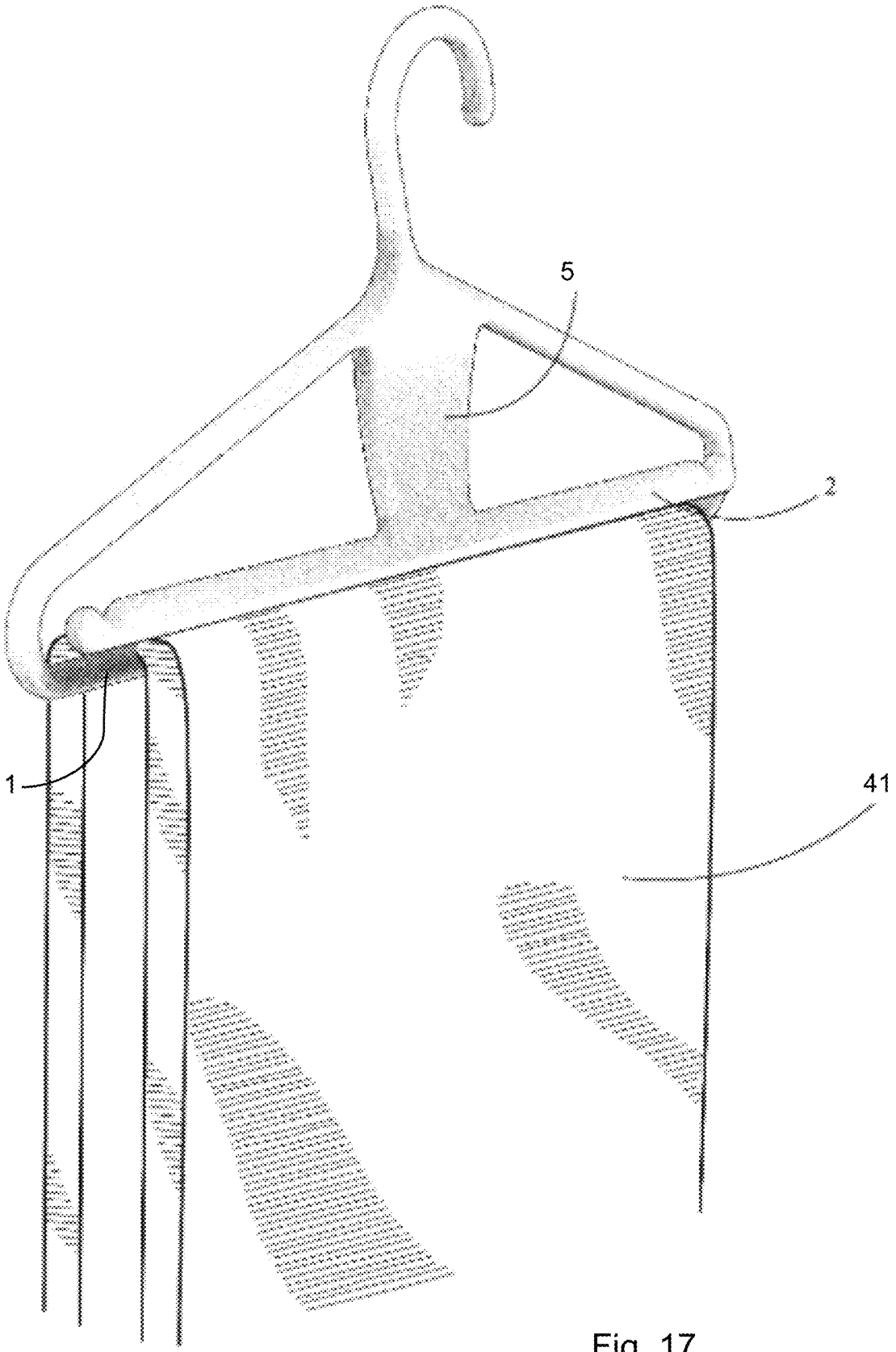
FIG. 17 shows a perspective view of a preferred garment hanger with a textile or clothing item in place and supported between a bottom support bar and a spring body.

FIG. 17 shows a perspective view of a preferred garment hanger, which is the same as shown in FIGS. 15 and 16, this time supporting a flat textile item or garment which may be a pair of pants 41. The garment 41 is held in place by the friction and spring force of the clip bar 2 pressing the garment against the support bar 1, as a consequence of the resilient force of the clip stem 5 providing an urging force to try to move the clip stem and clip bar to its resting position adjacent the support bar.

Figure 18:
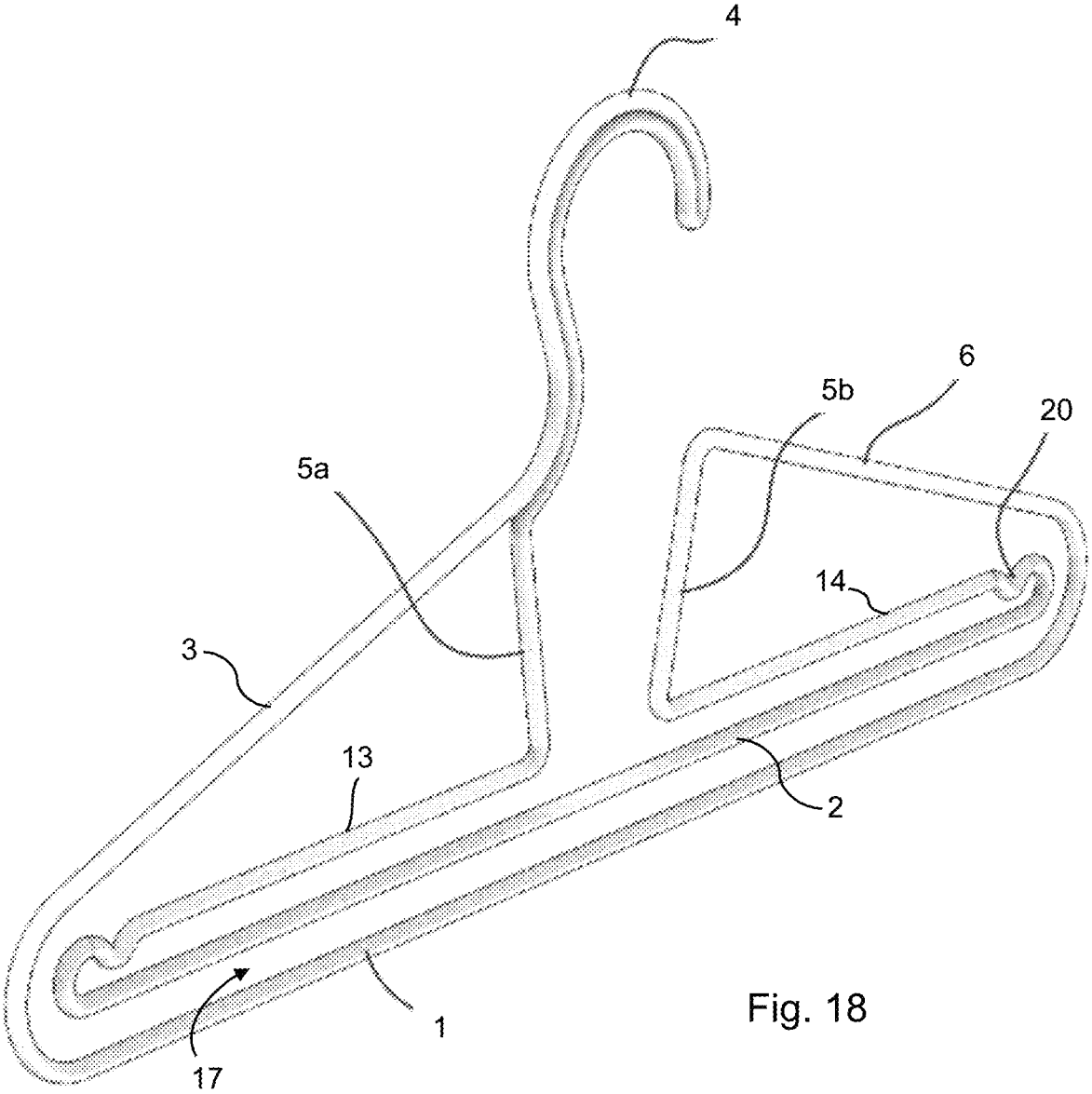
FIG. 18 shows an alternate embodiment of the invention, fabricated as a continuous section of wire.

FIG. 18 shows an alternate embodiment of a coat hanger which is constructed from wire rather than from a plastic material as with the prior preferred versions. Most preferably, the wire version is formed from a single metal wire which is bent into position and then the two ends of the single wire are welded or otherwise joined together to form the completed hanger.

In this specific possible embodiment, the clip stem is formed from two separated sections of wire 5*a*, 5*b*. The wires forming the clip stem transition to first and second clip bar portions 13, 14, which combine to form the clip bar 2. A gap 17 is provided between the clip bar 2 and horizontal support bar 1. The horizontal support bar transitions to a pair of shoulder bars 3, 6, and finally an upper hook 4. Strap wells, e.g. 20, may also be provided. The gap 17 as illustrated in FIG. 18 may appear to be somewhat large, but this is for ease of illustration. Preferably the gap 17 is small or zero in the resting position, as described for the other embodiments above.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

I claim:

1. A garment hanger, comprising:

a hook having a terminal end and a neck and defining an opening between the terminal end and the neck;

a first shoulder bar extending laterally away from the neck in a first direction and terminating in a first shoulder bar distal end;

a second shoulder bar extending laterally away from the neck in a second direction and terminating in a second shoulder bar distal end;

a support bar extending horizontally between the first shoulder bar distal end and the second shoulder bar distal end;

a clip stem having an upper end integrally formed with the garment hanger and extending from the neck, the clip stem having a clip stem distal end extending away from the upper end and toward the support bar, the clip stem further having a clip bar at the clip stem distal end wherein a gap is defined between the clip bar and the support bar, the clip bar further having a first horizontal bar portion extending horizontally toward the first shoulder bar distal end and a second horizontal bar portion extending horizontally toward the second shoulder bar distal end;

the garment hanger, including the hook, the first shoulder bar, the second shoulder bar, the support bar, the clip stem, the first horizontal bar portion and the second horizontal bar portion lying in a common plane, the clip stem and the clip bar being resiliently moveable between a resting position in which the clip bar is positioned adjacent the support bar and an open position in which the clip bar is moved away from the support bar upon application of an external force, the gap being relatively larger in the open position than in the resting position:

wherein the open position includes both a first open position in which the clip bar is moved in a first direction orthogonal to the common plane, and a second open position in which the clip bar is moved in a second direction which is opposite to the first direction and orthogonal to the common plane, the clip stem being configured to cause the clip bar to return to the resting position from the first open position and the second open position upon removal of the external force.

2. The garment hanger of claim 1, wherein the gap is less than 1 cm in the resting position.

3. The garment hanger of claim 1, wherein the upper end of the clip stem is attached to the neck.

4. The garment hanger of claim 3, wherein the upper end of the clip stem is further attached to at least one of the first shoulder bar or the second shoulder bar.

5. The garment hanger of claim 4, wherein the upper end of the clip stem is attached to both the first shoulder bar and the second shoulder bar.

6. The garment hanger of claim 1, wherein the upper end of the clip stem defines a first width and the clip stem distal end defines a second width, the first width being equal to the second width.

7. The garment hanger of claim 1, wherein the upper end of the clip stem defines a first width and the clip stem distal end defines a second width, the first width being greater than the second width.

8. The garment hanger of claim 1, further comprising a first strap well and a second strap well.

9. The garment hanger of claim 8, wherein the first strap well is formed in the first shoulder bar and the second strap well is formed in the second shoulder bar.

10. The garment hanger of claim 8, wherein the first strap well and the second strap well are each formed in the support bar.

11. The garment hanger of claim 8, wherein the first strap well and the second strap well are each formed in the clip bar.

12. The garment hanger of claim 1, wherein the garment hanger is integrally formed from a single material.

13. The garment hanger of claim 12, wherein the single material is plastic.

14. The garment hanger of claim 12, wherein the single material is a metal wire.

15. A garment hanger, comprising:

a hook having a terminal end and a neck and defining an opening between the terminal end and the neck;

a first shoulder bar extending downwardly away from the neck in a first direction and terminating in a first shoulder bar distal end;

a second shoulder bar extending downwardly away from the neck in a second direction and terminating in a second shoulder bar distal end;

a support bar extending between the first shoulder bar distal end and the second shoulder bar distal end;

a clip stem having an upper end attached to and suspended beneath the neck, the clip stem being resiliently moveable between a resting position and an open position;

the garment hanger, including the hook, the first shoulder bar, the second shoulder bar, the support bar, the clip stem, the first horizontal bar portion and the second horizontal bar portion being integrally formed from a single material and lying in a common plane, the clip stem having a clip stem distal end opposite the upper end, the clip stem distal end being positioned adjacent the support bar when the clip stem is in the resting position, wherein a gap is defined between the clip stem distal end and the support bar;

the clip stem in the open position being moved away from the support bar upon application of an external force, the gap being relatively larger in the open position than in the resting position.

16. The garment hanger of claim 15, wherein the gap is less than 1 cm in the resting position.

17. The garment hanger of claim 16, further comprising a clip bar having a first bar portion extending toward the first shoulder bar distal end, and a second bar portion extending toward the second shoulder bar distal end, the clip bar being positioned entirely within an interior space bounded by the first shoulder bar, the second shoulder bar, and the support bar, whereby the open position includes a first open position in which the clip bar is moved in a first direction orthogonal to the common plane, and a second open position in which the clip bar is moved in a second direction which is opposite to the first direction and orthogonal to the common plane, the clip stem being configured to cause the clip bar to return to the resting position from the first open position and the second open position upon removal of the external force.

18. The garment hanger of claim 17, wherein a portion of the first bar portion is adjacent to the first shoulder bar to define a first shoulder bar gap between the first bar portion and the first shoulder bar, and a portion of the second bar portion is adjacent to the second shoulder bar to define a second shoulder bar gap between the second bar portion and the second shoulder bar, each of the first shoulder bar gap and the second shoulder bar gap being less than 1 cm.

19. The garment hanger of claim 18, wherein the upper end of the clip stem defines a first width and the distal end of the clip stem defines a second width, the first width being greater than the second width.

* * * * *